US007250581B2

(12) United States Patent
Asada

(10) Patent No.: US 7,250,581 B2
(45) **Date of Patent: *Jul. 31, 2007**

(54) PUSH-ON SWITCH

(75) Inventor: Makoto Asada, Nara (JP)

(73) Assignee: Hosiden Corporation, Yao Shi, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/288,108

(22) Filed: Nov. 29, 2005

(65) Prior Publication Data

US 2006/0131153 A1 Jun. 22, 2006

(30) Foreign Application Priority Data

Dec. 7, 2004 (JP) ..... 2004-353539

(51) Int. Cl.
*H01H 3/12* (2006.01)

(52) U.S. Cl. ..... 200/341; 200/314

(58) Field of Classification Search ..... 200/5 A, 200/5 R, 510–520, 314, 341
See application file for complete search history.

(56) References Cited

U.S. PATENT DOCUMENTS 5,898,147 A * 4/1999 Domzalski et al. ..... 200/1 B
6,271,491 B1 * 8/2001 Ono et al. ..... 200/520
6,771,253 B2 * 8/2004 Wu ..... 345/170
6,906,274 B2 * 6/2005 Ito et al. ..... 200/512
6,995,324 B2 * 2/2006 Asada ..... 200/1 B
2005/0018420 A1 * 1/2005 Parsons ..... 362/190
2005/0236265 A1 * 10/2005 Kobayashi et al. ..... 200/511
2006/0024111 A1 * 2/2006 Dombrowski et al. ..... 400/490
2006/0180453 A1 * 8/2006 Steidle et al. ..... 200/341

FOREIGN PATENT DOCUMENTS

EP 1670012 * 6/2006
JP 2003-7167 1/2003

* cited by examiner

*Primary Examiner*—K. Lee
*Assistant Examiner*—Lisa Klaus
(74) *Attorney, Agent, or Firm*—Bacon & Thomas, PLLC

(57) ABSTRACT

A push-on switch in which dome-like movable contacts are placed in an invertible manner in two or upper and lower stages in an accommodating portion of an insulative body having plural stationary contacts. In order to fix the lower movable contact without using a dedicated pressing member, and enhance cost reduction and production efficiency, a leg portion is elongated from an outer peripheral edge portion of the lower movable contact, and the leg portion has a pressed portion in which a tip end is upward bent to protrude toward an upper face of the upper movable contact. When the lower mov-able contact is positionally fixed to the body, the pressed portion is pressed from the upper side by fixing structure for the upper movable contact, and the lower movable contact is positionally fixed.

9 Claims, 3 Drawing Sheets

PUSH-ON SWITCH

BACKGROUND OF THE INVENTION

1. Field of the Invention

The present invention relates to a push-on switch in which a dome-like movable contact is inverted as a result of a depressing operation to make electrical conduction, and more particularly to a two-step push-on switch into which two or upper and lower movable contacts are incorporated.

2. Description of the Prior Art

In a push-on switch of this kind, the upper movable contact is placed in an accommodating portion of a body, and fixed by attaching a frame having a window hole at the middle to an upper face of the body via a cover sheet covering the accommodating portion and exerting also a function of dust proof, and pressing the cover sheet from the upper side. On the other hand, the lower movable contact is placed in the accommodating portion of the body and under the upper movable contact, and fixed by bonding and holding the whole outer peripheral edge portion by an annular adhesive sheet having a through hole in the middle, to the body, whereby a top of an inflated portion is exposed to be contactable to the upper movable contact in the upper side. Such a conventional push-on switch is disclosed in Japanese Patent Application Laying-Open No. 2003-7167.

SUMMARY OF THE INVENTION

Problems which are to be solved by the invention are that, in the fixing method in which the outer peripheral edge portion of the lower movable contact is bonded and held to the body by the annular adhesive sheet, the adhesive sheet is additionally used and hence the number of parts is increased, and also that the adhesive sheet must be accurately bonded in the process of incorporating into the lower movable contact, and hence the production efficiency is lowered.

The invention has been conducted in view of the above-mentioned circumstance. It is an object of the invention to provide a push-on switch in which a lower movable contact can be fixed to a body without using a dedicated pressing member such as an adhesive sheet, whereby cost reduction and improvement of the production efficiency can be realized.

In order to attain the object, the invention is characterized in that, in a two-step push-on switch in which dome-like movable contacts are placed in an invertible manner in two or upper and lower stages in an accommodating portion of an insulative body having plural stationary contacts, a leg portion is elongated from an outer peripheral edge portion of the lower movable contact, and the leg portion has a pressed portion in which a tip end is upward bent to protrude toward an upper face of the upper movable contact.

According to the invention, the pressed portion disposed at the tip end of the leg portion of the lower movable contact protrudes toward the upper face of the upper movable contact. When the position of the upper movable contact is fixed to the body, therefore, the pressed portion is pressed by fixing means for the upper movable contact to play a role of restricting rising of the lower movable contact and positionally fixing the contact. As a result, the lower movable contact can be positionally fixed without using a dedicated pressing member. Therefore, it is possible to attain the effects that the number of parts can be reduced, and that cost reduction of the push-on switch and improvement of the production efficiency can be realized.

DETAILED DESCRIPTION OF THE PREFERRED EMBODIMENT

Figure 1:
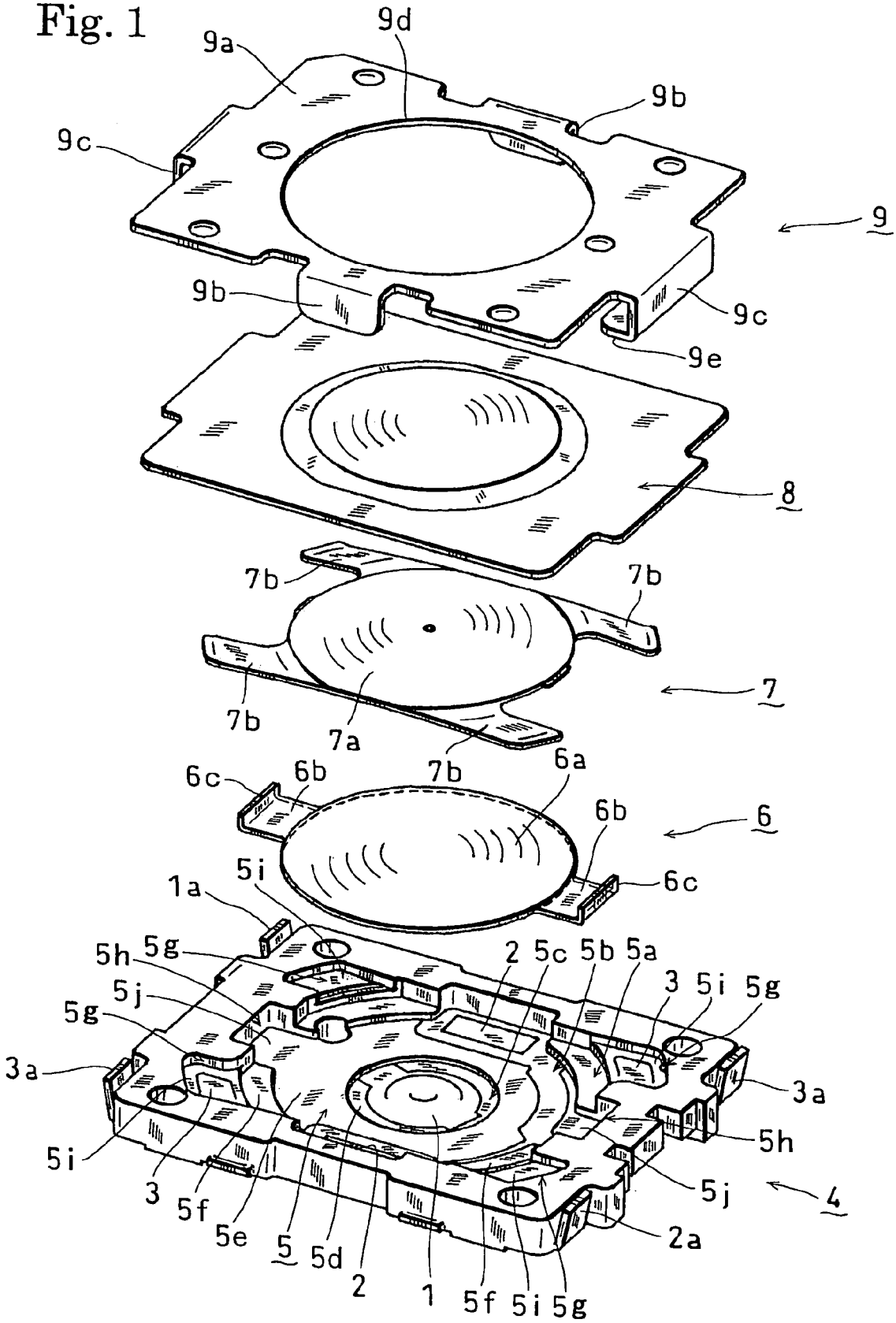
FIG. 1 is an exploded perspective view of a push-on switch of an embodiment of the invention.

Hereinafter, a push-on switch S which is an embodiment of the invention will be described with reference to the accompanying drawings.

The illustrated push-on switch S will be schematically described. Two dome-like movable contacts 6, 7 having different sizes and shapes are disposed in two or upper and lower stages in an accommodating portion 5 of a body 4 having a plurality of stationary contacts 1, 2, 3, and the movable contacts 6, 7 are positionally fixed in an invertible manner to the body 4, thereby configuring a two-step push-on switch (push-button switch).

Next, the configurations of the components of the push-on switch S will be described. First, the body 4 is made of an insulating material such as a synthetic resin, and formed into a shallow box-like structure (tray-like structure) in which the stepped and recessed accommodating portion 5 is formed in the inner middle area, which has a rectangular external shape, and in which the upper face is opened.

The accommodating portion 5 is configured by: an upper recess 5*a* which is formed by recessing the upper face of the body 4 by one step into an oval shape while not recessing the outer peripheral edge portion; a middle recess 5*b* which is formed by recessing a middle area of the oval bottom face of the upper recess 5*a* by one step into a circular shape; and a lower recess 5*c* which is formed by recessing a middle area of the circular bottom face of the middle recess 5*b* by one step into a circular shape. The recesses 5*a*, 5*b*, 5*c* are located concentric with the center of the body 4. The upper recess 5*a* is disposed so that both arcuate end portions are opposed to one set of short sides which are opposed to each other in the longitudinal direction of the body 4, and both linear side edges are parallel to the long sides which are opposed to each other in the lateral direction of the body 4. According to the configuration, a middle bottom face (the circular bottom face of the lower recess 5*c*) 5*d* which is horizontal and circular is formed in the deepest portion of the accommodating portion 5. A first peripheral bottom face (the outer peripheral edge portion of the bottom face of the middle recess 5*b*) 5*e* that is horizontal and annular is formed at a position which is in the periphery of the middle bottom face 5*d*, and which is higher in level by one step than the middle bottom face. A second peripheral bottom face (both end portions of the bottom face of the upper recess 5*a* in the longitudinal direction of the body 4) 5*f* that is horizontal and arcuate is formed at two positions which sandwich the first peripheral bottom face 5*e* in the longitudinal direction of the body 4, and which are higher in level by one step than the first peripheral bottom face 5*e*.

First leg accommodating recesses 5*g* which are continuous to the accommodating portion 5, and which are to accommodate leg portions 7*b* (described later) of the upper movable contact 7 are formed in four corners of the upper face of the body 4, respectively. Second leg accommodating recesses 5*h* which are continuous to the accommodating portion 5, and which are to accommodate leg portions 6*b* (described later) of the lower movable contact 6 are formed between the two first leg accommodating recesses 5*g* on one side in the longitudinal direction of the upper face of the body 4, and the two first leg accommodating recesses 5*g* on the other side in the longitudinal direction of the upper face. The first leg accommodating recesses 5*g* are formed so as to have a depth which is shallower than the depth of the upper recess 5*a* from the upper face of the body 4. Inner ends of the first leg accommodating recesses 5*g* are continuously connected to four corners of the upper recess 5*a* in positions which are higher in level by one step than the second peripheral bottom face 5*f*, respectively. According to the configuration, third peripheral bottom faces 5*i* (bottom faces of the first leg accommodating recesses 5*g*) which are higher in level by one step than the second peripheral bottom face 5*f* are formed in four corners of the accommodating portion 5, respectively. On the other hand, the second leg accommodating recesses 5*h* are formed so as to have the same depth as the middle recess 5*b* from the upper face of the body 4, and inner ends of the second leg accommodating recesses 5*h* are continuously connected to the middle recess 5*b* on the longitudinal center line of the body 4. According to the configuration, first peripheral bottom face projecting portions 5*j* are disposed which project flushly continuously from the first peripheral bottom face 5*e* on the longitudinal center line of the body 4, which cross the second peripheral bottom face 5*f* to interrupt it, and which form the bottom faces of the second leg accommodating recesses 5*h*.

Each of the plural stationary contacts 1, 2, 3 provided on the body 4 is formed by a thin metal plate, and attached integrally to the body 4 by insert molding. The stationary contacts are configured respectively by: a middle stationary contact 1 which is disposed in a middle area of the middle bottom face 5*d*, integrally with the body 4 in a state where one end portion is exposed; first peripheral stationary contacts 2 which are disposed at symmetric positions of the outer peripheral edge portion of the first peripheral bottom face 5*e* on the lateral center line of the body 4, integrally with the body 4 in a state where one end portion is exposed; and second peripheral stationary contacts 3 which are disposed on the third peripheral bottom faces 5*i* positioned in a diagonal direction of the body 4, integrally with the body 4 in a state where one end portion is exposed. Four end portions of the stationary contacts in total, or another end portion of the middle stationary contact 1, a common other end portion of the first peripheral stationary contacts 2, and other end portions of the second peripheral stationary contacts 3 are projected respectively from four lower end portions of one set of short side faces which are opposed to each other in the longitudinal direction of the body 4, thereby forming external contacts 1*a*, 2*a*, 3*a* for conductors of a circuit board which is not shown.

The lower movable contact 6 is formed by a thin metal plate spring, and configured by: an invertible contact body 6*a* which is circular, which has a diameter that is slightly smaller than that of the middle recess 5*b*, and which has a dome-like shape that is upward inflatingly curved; and right and left leg portions 6*b* which are elongated radially outward from the outer peripheral edge of the contact body 6*a* at an interval of 180 deg., and which can be accommodated in the second leg accommodating recesses 5*h*, respectively. Each of the leg portions 6*b* has a pressed portion 6*c* in which the tip end is upward bent to restrict restricting rising of the lower movable contact 6. The pressed portions 6*c* are formed so as to have a height which is substantially equal to the depth of the second leg accommodating recesses 5*h* from the upper face of the body 4.

Figure 3:
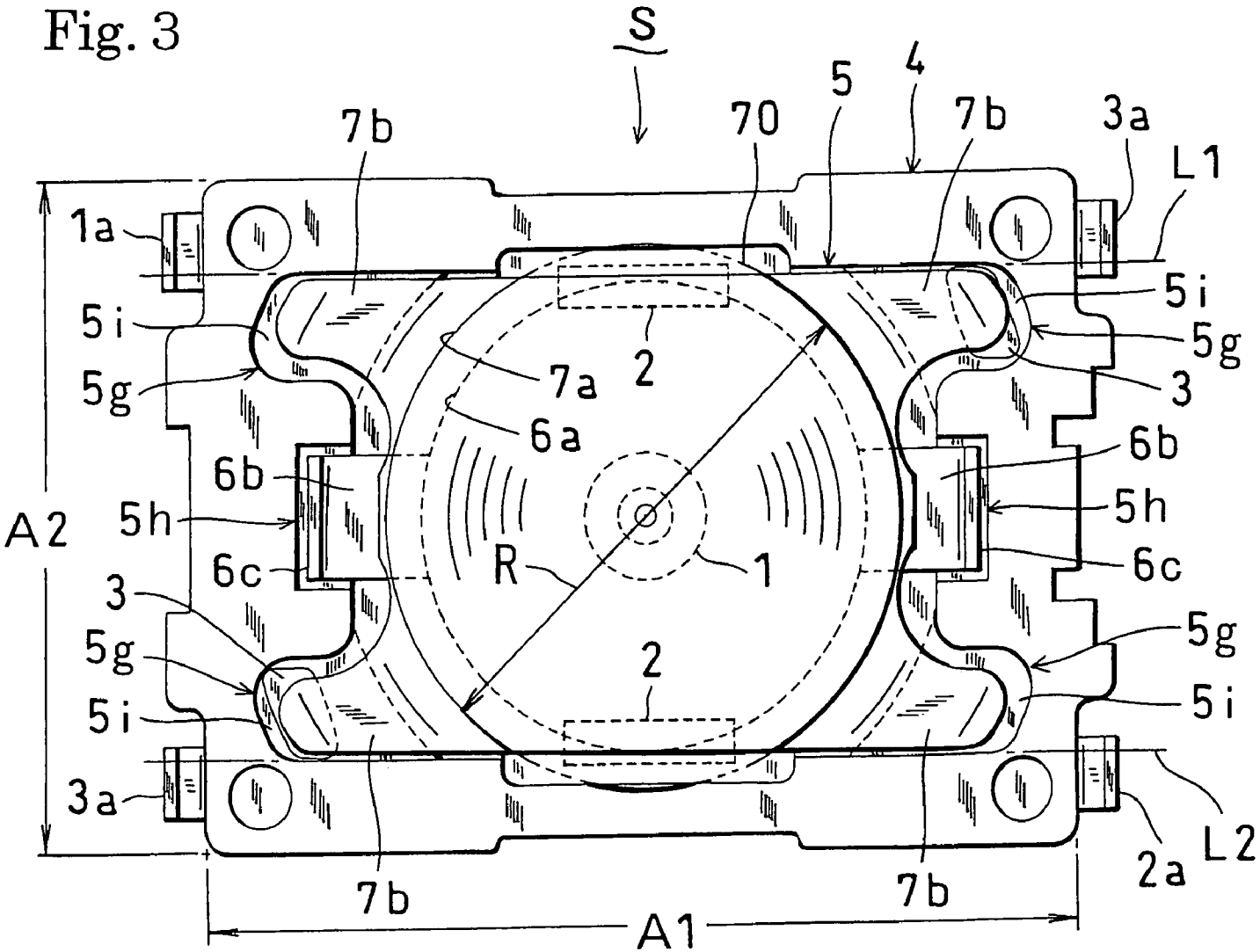
FIG. 3 is a plan view of an assembled state of the push-on switch of the embodiment of the invention in which a dust-proof tape and a cover are removed away.

The upper movable contact 7 is formed by a thin metal plate spring, and configured by: an invertible contact body 7*a* which has a size that can cover the lower movable contact 6 from the upper side, which is oval unlike the lower movable contact 6, and which has a dome-like shape that is upward inflatingly curved; and four leg portions 7*b* which are elongated from four corners of the contact body 7*a* in the longitudinal direction, and which can be accommodated in the first leg accommodating recesses 5*g*, respectively. More specifically, the upper movable contact 7 is configured in the following manner. The contact body 7*a* has a diameter R which is larger at least than the diameter of the contact body 6*a* of the lower movable contact 6, and smaller than the width A1 of the longitudinal side of the body 4 (in the embodiment, the upper movable contact having a diameter R which is larger than the diameter of the contact body 6*a* of the lower movable contact 6, and smaller than the width A2 of the lateral side of the body 4 is shown). The upper movable contact is formed into an oval shape in which edge portions of a dome-like disc 70 (see the phantom lines in FIG. 3) that is upward inflatingly curved are cut away by two parallel lines L1, L2 that are parallel to one set of longitudinal sides opposed to each other in the lateral direction of the body 4, and that have a relative distance which is smaller than the relative distance between the longitudinal sides, i.e., the width A2 of the lateral side of the body 4, and larger than the diameter of the contact body 6*a* of the lower movable contact 6. The upper movable contact is formed so as to be accommodable in the upper recess 5*a* of the body 4 in a direction (posture) in which, in a plan view, the linear cut edges of the contact body 7*a* are elongated along the one set of longitudinal sides opposed in the lateral direction of the body 4, and the arcuate uncut edges are opposed to the one set of lateral sides opposed in the longitudinal direction of the body 4. The leg portions 7*b* which can be accommodated in the first leg accommodating recesses 5*g* are elongated integrally and continuously from the four corners of the oval contact body 7*a*, in the longitudinal direction.

The push-on switch S includes a dust-proof tape 8 and a cover 9 in addition to the body 4, the lower movable contact 6, and the upper movable contact 7.

The dust-proof tape 8 is configured by a soft bonding tape (adhesive tape) having a bonding layer (adhesive layer) on one face, and formed into a size and a shape (in the embodiment, a rectangular shape is shown) which can cover a substantially whole area of the upper face of the body 4 and hermetically seal the accommodating portion 5.

The cover 9 is formed by a thin metal plate, and configured by: a rectangular top plate 9*a* which is to overlap with the upper face of the body 4; first positioning pieces 9*b* laterally disposed, which are downward elongated from middle areas of one set of longitudinal sides opposed to each other in the lateral direction of the top plate 9*a*, along one set of longitudinal sides opposed to each other in the lateral direction of the body 4; and second positioning pieces 9*c* longitudinally disposed, which are downward elongated from middle areas of one set of lateral sides opposed to each other in the longitudinal direction of the top plate 9*a*, along one set of lateral sides opposed to each other in the longitudinal direction of the body 4. A window hole 9*d* through which the contact body 7*a* of the upper movable contact 7 is to be exposed from the upper face of the top plate 9*a* is formed in a middle area of the top plate 9*a*. The first positioning pieces 9*b* are formed to have a length which is approximately equal to or smaller than the thickness of the body 4. On the other hand, the second positioning pieces 9*c* are formed to have a length which is larger than the thickness of the body 4 so that, after the cover 9 is attached to the body 4, tip end portions of the second positioning pieces 9*c* can be inwardly bent and engaged with engaging grooves 5*k* formed in the bottom face of the body 4.

Next, the manner of assembling the push-on switch S will be described. First, the contact body 6*a* of the lower movable contact 6 is fitted into the accommodating portion 5 while the two leg portions 6*b* of the lower movable contact 6 are fitted into the second leg accommodating recesses 5*h* from the side of the upper face of the body 4. As a result, the lower faces of the leg portions 6*b* butt against the first peripheral bottom face projecting portions 5*j*, an outer peripheral edge portion of the contact body 6*a* butts against the first peripheral bottom face 5*e*, and the lower movable contact 6 is incorporated into the middle recess 5*b* of the accommodating portion 5 of the body 4. Since the lower movable contact 6 is incorporated into the middle recess 5*b* of the accommodating portion 5 of the body 4, a part of the outer peripheral edge portion of the contact body 6*a* is contacted with the first peripheral stationary contacts 2 provided in the body 4 to be electrically connected thereto. Next, the contact body 7*a* of the upper movable contact 7 is fitted into the accommodating portion 5 while the four leg portions 7*b* of the upper movable contact 7 are fitted into the first leg accommodating recesses 5*g* from the side of the upper face of the body 4. As a result, the lower faces of tip end portions of the leg portions 7*b* butt against the third peripheral bottom faces 5*i*, and the upper movable contact 7 is incorporated into the upper recess 5*a* in the accommodating portion 5 of the body 4 in a state where the contact body 7*a* is supported above the opening of the upper recess 5*a* of the accommodating portion 5 to protrude toward the upper face of the body 4. Since the upper movable contact 7 is incorporated into the upper recess 5*a* in the accommodating portion 5 of the body 4, the lower faces of the tip end portions of the two leg portions 7*b* positioned in a diagonal direction of the body 4 are contacted with the second peripheral stationary contacts 3 provided in the body 4 to be electrically connected thereto. Next, the dust-proof tape 8 is bonded to the upper face of the body 4, and then the cover 9 is placed from the side of the upper face of the body 4 to overlay the top plate 9*a* on the upper face of the body 4 via the dust-proof tape 8. The tip end portions of the second positioning pieces 9*c* protruding toward the bottom face of the body 4 are inward bent, and engaged with the engaging grooves 5*k* of the body 4. As a result, the first positioning pieces 9*b* sandwich the body 4 in the lateral direction, and the second positioning pieces 9*c* sandwich the body 4 in the longitudinal direction, and cooperate with the top plate 9*a* to sandwich the body 4 in the thickness direction, whereby the cover 9 is fixed to the body 4. Since the cover 9 is fixed to the body 4, the contact body 7*a* of the upper movable contact 7 which is covered by the dust-proof tape 8 is upward projected from the window hole 9*d* in the middle area of the top plate 9*a*, and the top plate 9*a* is attached to the upper face of the body 4 in a state where the outer peripheral edge portion of the dust-proof tape 8 is sandwiched between the outer peripheral edge portion of the top plate 9*a* and that of the upper face of the body 4.

Figure 2:
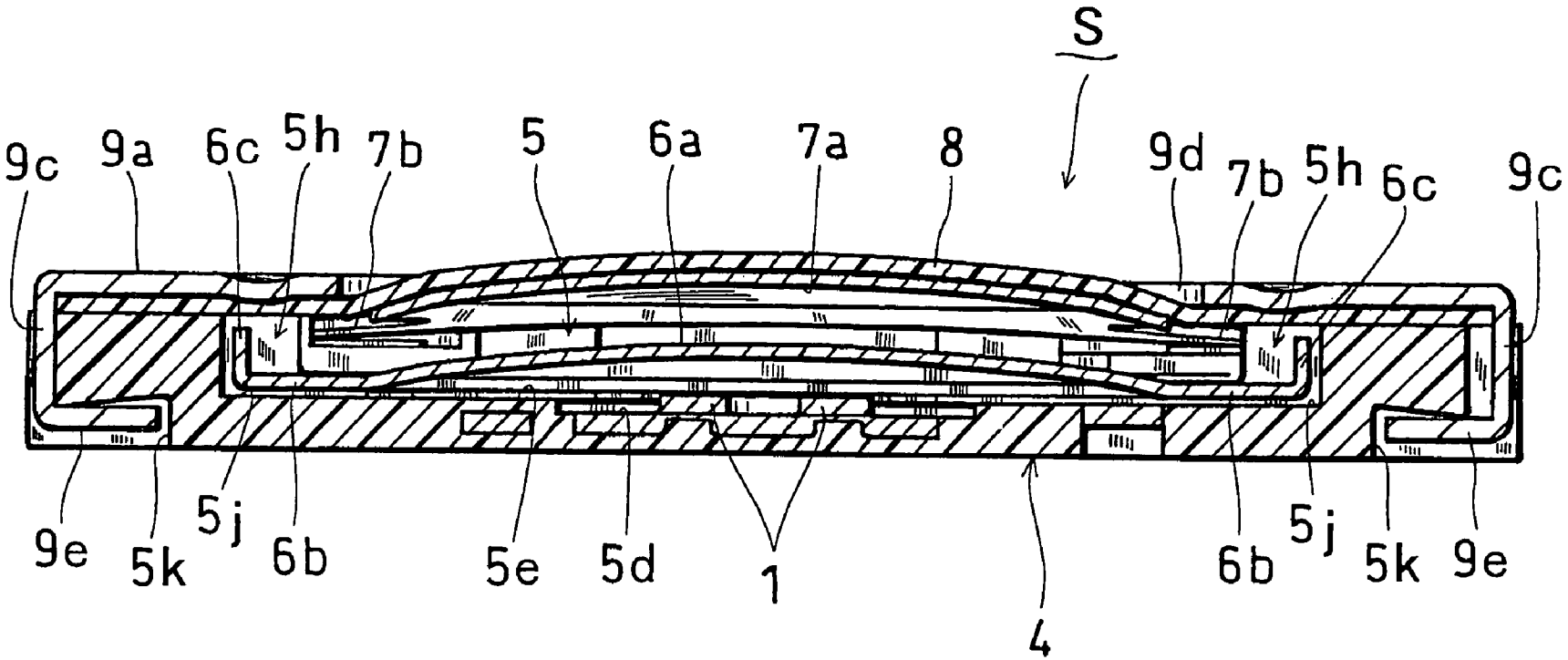
FIG. 2 is a side section view of an assembled state of the push-on switch of the embodiment of the invention.

As a result, as shown in FIG. 2, it is possible to assemble the two-step push-on switch S in which the lower movable contact 6 and the upper movable contact 7 are placed and accommodated in an invertible manner in two or upper and lower stages in the accommodating portion 5 of the body 4, in a state where the contact body 6*a* of the lower movable contact 6 is separated and opposed above the middle stationary contact 1 of the body 4, a part of the outer peripheral edge portion of the contact body 6*a* of the lower movable contact 6 is always in contact with the first peripheral stationary contacts 2 of the body 4 to be electrically connected to each other, the contact body 7*a* of the upper movable contact 7 is separated and opposed above the contact body 6*a* of the lower movable contact 6, and the lower faces of the tip end portions of the two leg portions 7*b* of the upper movable contact 7 are always electrically connected to the second peripheral stationary contacts 3 of the body 4.

In the thus assembled push-on switch S, the outer peripheral edge portion of the oval contact body 7*a* is fitted into the upper recess 5*a* of the accommodating portion 5 disposed in the middle area of the upper face of the body 4, and the four leg portions 7*b* which are elongated from the four corners of the contact body 7*a* in the longitudinal direction are fitted into the leg accommodating recesses 5*g* which are formed in the four corners of the upper face of the body 4, respectively. By these fittings, therefore, longitudinal and lateral movements of the upper movable contact 7 are restricted, and the upper movable contact 7 is positionally fixed. Furthermore, longitudinal and lateral movements of the upper movable contact 7 are restricted also by the dust-proof tape 8 bonded to the upper face of the oval contact body 7*a*, and, since the upper movable contact is pressed from the upper side by the dust-proof tape 8, rising (movement of the vertical direction) is restricted, whereby the upper movable contact 7 is positionally fixed.

In the thus assembled push-on switch S, the circular contact body 6*a* is fitted into the middle recess 5*b* of the accommodating portion 5 disposed in the middle area of the upper face of the body 4, and the two leg portions 6*b* which are elongated from the contact body 6*a* in the longitudinal direction of the body 4 are fitted into the second leg accommodating recesses 5*h* which are formed between the two first leg accommodating recesses 5*g* on one side in the longitudinal direction of the body 4, and the two first leg accommodating recesses 5*g* on the other side in the longitudinal direction. By these fittings, therefore, longitudinal and lateral movements of the lower movable contact 6 are restricted, and the lower movable contact 6 is positionally fixed. Furthermore, the leg portions 6*b* of the lower movable contact 6 which are fitted into the second leg accommodating recesses 5*h* of the body 4 have the pressed portions 6*c* which are formed by upward bending the tip ends, the pressed portions 6*c* protrude toward the upper face of the upper movable contact 7 with passing between the two leg portions 7*b* on one side in the longitudinal direction of the upper movable contact 7, and between the two leg portions 7*b* on the other side in the longitudinal direction, the tip ends of the pressed portions 6 face the upper faces of the openings of the second leg accommodating recesses 5*h* of the body 4, and the upper faces of the openings are covered and closed by the dust-proof tape 8 and the top plate 9*a* of the cover 9. Even when the lower movable contact 6 tends to rise, therefore, the pressed portions 6*c* at the tip ends of the leg portions 6*b* can be pressed from the upper side by the dust-proof tape 8 and the top plate 9*a* of the cover 9, and hence the lower movable contact 6 can be positionally fixed with restricting rising (movement of the vertical direction).

In the case where the fixing method in which the lower movable contact 6 is bonded and held to the body 4 by an annular adhesive sheet as in the conventional art is employed, the addition of the adhesive sheet increases the number of parts. During the assembling process, a step of bonding the adhesive sheet must be conducted between a step of incorporating the lower movable contact 6 and that of incorporating the upper movable contact 7, and the adhesive sheet must be accurately bonded. Therefore, the number of production steps is increased, and the production efficiency is lowered. In the embodiment, the lower movable contact 6 is positionally fixed without using an adhesive sheet as described above, and hence the number of parts can be reduced so that the push-on switch S can be produced economically, easily, and efficiently. Furthermore, a space for bonding an adhesive sheet is not required to be formed in the accommodating portion 5 of the body 4, and also a space for accommodating a part of pressing the lower movable contact is not necessary to be ensured between the two or upper and lower movable contacts 7, 6. Therefore, the push-on switch S can be reduced in size and profile.

Since the pressed portions 6*c* of the lower movable contact 6 are projected between the leg portions 7*b* toward the upper face of the upper movable contact 7, the lower movable contact 6 can be positionally fixed within an area for accommodating the upper movable contact 7. Therefore, the size of the push-on switch S is not increased.

Next, the operation of the push-on switch S will be described. In a state where the push-on switch S is not depressed, as shown in FIG. 2, the lower faces of the tip end portions of the two leg portions 7*b* of the upper movable contact 7 are contacted with the second peripheral stationary contacts 3 to attain electrical conduction, but the contact body 7*a* is returned to an upward inflated dome-like shape, and separated from the contact body 6*a* of the lower movable contact 6. In the lower movable contact 6, a part of the outer peripheral edge portion of the contact body 6*a* is in contact with the first peripheral stationary contacts 2 to attain electrical conduction, but the contact body 6*a* is returned to an upward inflated dome-like shape, and separated from the middle stationary contact 1. Therefore, both the two or upper and lower step switches are in the OFF state.

In the state of FIG. 2, then, the central area of the contact body 7*a* of the upper movable contact 7 is downward depressed from the side above the dust-proof tape 8 by an operating member such as a key top. When the contact body 7*a* of the upper movable contact 7 cannot withstand the depressing force, the upper movable contact 7 is rapidly inverted to a downward inflated state, and the lower face of the central area is contacted with the upper face of the top portion of the contact body 6*a* of the lower movable contact 6, so that the upper movable contact 7 and the lower movable contact 6 are electrically connected to each other. The second peripheral stationary contacts 3 and the first peripheral stationary contacts 2 are connected to each other through the upper and lower movable contacts 7 and 6 which are in the electrically conductive state, thereby causing the first-step (upper) switch to enter the ON state with producing an operation sense.

When, in the state where the first-step switch is turned ON as described above, the central area of the contact body 7*a* of the upper movable contact 7 is further downward depressed from the side above the dust-proof tape 8 by the operating member, the upper face of the top portion of the contact body 6*a* of the lower movable contact 6 is downward depressed by the lower face of the central area of the contact body 7*a* of the upper movable contact 7. When the contact body 6*a* of the lower movable contact 6 cannot withstand the depressing force, the lower movable contact 6 is rapidly inverted to a downward inflated state, and the lower face of the central area makes contact with the middle stationary contact 1, and the first peripheral stationary contacts 2 and the middle stationary contact 1 are connected to each other through the lower movable contact 6, thereby causing the second-step (lower) switch to enter the ON state with producing an operation sense.

When, in the state where the second-step switch is turned ON as described above, the depressing force which is applied to the contact body 7*a* of the upper movable contact 7 by the operating member is cancelled, first, the contact body 6*a* of the lower movable contact 6 is returned to its initial state or the upward inflated dome-like shape by the elasticity of itself, to attain a state where the contact body is separated from the middle stationary contact 1. Then, the contact body 7*a* of the upper movable contact 7 is returned to its initial state or the upward inflated dome-like shape by the elasticity of itself, to attain a state where the contact body 7*a* is separated from the contact body 6*a* of the lower movable contact 6. As a result, both the upper- and lower-step switches enter the OFF state.

The lower movable contact 6 has the simple circular shape in which the leg portions 6*b* that are irrelevant to stress, and that are used for pressing the lower movable contact are added to the circular contact body 6*a* that has the upward inflated dome-like shape, and that is invertible, i.e., a circular plate spring. Therefore, the characteristics of the circular plate spring are not in any way impaired, and a large life number of ON/OFF operations can be obtained.

The contact body 7*a* of the upper movable contact 7 is formed into an oval shape. Even in the case where, when a depressing operation is applied so as to cause the second-step switch to be turned ON, the central area of the upper movable contact 7 is largely displaced, therefore, a stress produced in the contact body 7*a* is relaxed, whereby failures such as cracks or deflection (creep) can be prevented from occurring and a large life number of ON/OFF operations can be obtained. Usually, a body which accommodates a circular dome-like movable contact having a diameter of R must be formed into a square shape having sides of A1. By contrast, since the contact body 7*a* of the upper movable contact 7 is formed into an oval shape, the width of the body 4 in the lateral direction of the upper movable contact 7 can be made smaller than the width of the upper movable contact 7 in the longitudinal direction (A1>A2), while ensuring the same operation stroke as a circular dome-like movable contact having a diameter of R. Therefore, the assembled two-step push-on switch S can be miniaturized with respect to the external dimension in the width direction. The push-on switch S is mounted on an apparatus such as an electronic apparatus or a communication apparatus, in a state where the external contacts 1*a*, 2*a*, 3*a* protruding from the body 4 are electrically connected by soldering to contacts (conductors) formed on a circuit board of the apparatus. Since miniaturization in which the dimensions, particularly the width are reduced is realized, the switch can be easily mounted even in a side face of a thin apparatus such as a portable telephone. The leg portions 7*b* of the upper movable contact 7 are elongated from the four corners of the oval contact body 7*a* in the longitudinal direction, and hence do not constitute an obstacle to miniaturization with respect to the width of the push-on switch S.

What is claimed is:

1. A push-on switch in which dome-like movable contacts are placed in an invertible manner in two or upper and lower stages in an accommodating portion of an insulative body having plural stationary contacts, wherein a leg portion is elongated from an outer peripheral edge portion of said lower movable contact, and said leg portion has a pressed portion in which a tip end is upward bent to protrude toward an upper face of said upper movable contact.

2. A push-on switch according to claim 1, wherein a dust-proof tape which is bonded to an upper face of said body after said lower movable contact and said upper movable contact are incorporated in an invertible manner into two or upper and lower stages in said accommodating portion of said body, and a cover which is formed by a thin metal plate, which has a window hole in a middle area, which is placed from an upper face side on said body in which said dust-proof tape is bonded to the upper face, and which is fixed to said body in a state where a dome-like invertible contact body of said upper movable contact covered by said dust-proof tape upward protrudes through said window hole are disposed, said upper movable contact is positionally fixed by pressing from an upper side said contact body of said upper movable contact by said dust-proof tape, and said lower movable contact is positionally fixed by pressing from an upper side said pressed portion of said lower movable contact by said dust-proof tape.

3. A push-on switch according to claim 2, wherein a plurality of leg portions are elongated from an outer peripheral edge portion of said upper movable contact, and said pressed portion of said lower movable contact protrudes toward the upper face of said upper movable contact with passing between said leg portions of said upper movable contact.

4. A push-on switch according to claim 3, wherein said body is made of an insulating material such as a synthetic resin, and formed into a shallow box-like structure in which a stepped and recessed accommodating portion is formed in a inner middle area, which has a rectangular external shape, and in which an upper face is opened, said accommodating portion has: an upper recess which is formed by recessing the upper face of said body by one step into an oval shape while not recessing an outer peripheral edge portion; a middle recess which is formed by recessing a middle area of an oval bottom face of said upper recess by one step into a circular shape; and a lower recess which is formed by recessing a middle area of a circular bottom face of said middle recess by one step into a circular shape, said recesses are located concentric with a center of said body, first leg accommodating recesses which are continuous to said accommodating portion, and which are to accommodate said leg portions of said upper movable contact are formed in four corners of the upper face of said body, respectively, second leg accommodating recesses which are continuous to said accommodating portion, and which are to accommodate said leg portions of said lower movable contact are formed between two first leg accommodating recesses on one side in a longitudinal direction of the upper face of said body, and two first leg accommodating recesses on another side in the longitudinal direction of the upper face, said first leg accommodating recesses are formed to have a depth which is shallower than a depth of said upper recess from the upper face of said body, inner ends of said first leg accommodating recesses are continuously connected to four corners of said upper recess, respectively, said second leg accommodating recesses are formed to have a same depth as said middle recess from the upper face of said body, inner ends of said second leg accommodating recesses are continuously connected to said middle recess on a longitudinal center line of said body, said plural stationary contacts are configured by: a middle stationary contact which is formed by a thin metal plate, and which is disposed in a circular bottom face of the lower recess, integrally with said body in a state where one end portion is exposed; first peripheral stationary contacts which are formed by a thin metal plate, and which are disposed at symmetric positions of an annular bottom face of said middle recess on a lateral center line of said body, integrally with said body in a state where one end portion is exposed; and second peripheral stationary contacts which are formed by a thin metal plate, and which are disposed on bottom faces of two first leg accommodating recesses positioned in a diagonal direction of said body, integrally with said body in a state where one end portion is exposed, and another end portion of said middle stationary contact, a common other end portion of said first peripheral stationary contacts, and other end portions of said second peripheral stationary contacts are projected respectively from said body, thereby forming external contacts.

5. A push-on switch according to claim 4, wherein said lower movable contact is formed by a thin metal plate, and configured by: an invertible contact body which is circular, which has a diameter that is slightly smaller than that of said middle recess, and which has a dome-like shape that is upward inflatingly curved; and right and left leg portions which are elongated radially outward from an outer peripheral edge of said contact body at an interval of 180 deg., said leg portions have pressed portions in which the tip end is upward bent, respectively, said pressed portions are formed to have a height which is substantially equal to a depth of said second leg accommodating recesses from the upper face of said body, said contact body of said lower movable contact is fitted into said accommodating portion while said two leg portions of said lower movable contact are fitted into said second leg accommodating recesses from a side of the upper face of said body, lower faces of said leg portions butt against second leg accommodating recesses, respectively, and said lower movable contact is incorporated into said middle recess of said accommodating portion of said body in a state where an outer peripheral edge portion of said contact body butts against a bottom face of said middle recess to contact said outer peripheral edge portion of said contact body with said first stationary contacts to be electrically connected thereto.

6. A push-on switch according to claim 5, wherein said upper movable contact is formed by a thin metal plate, and configured by: an oval invertible contact body which has a size that can cover said lower movable contact from an upper side, and which has a dome-like shape that is upward inflatingly curved; and four leg portions which are elongated from four corners of said contact body in a longitudinal direction, respectively, said contact body of said upper movable contact is fitted into said accommodating portion while, after said lower movable contact is incorporated into said middle recess in said accommodating portion of said body, four leg portions of said upper movable contact are fitted into said first leg accommodating recesses from the side of the upper face of said body, and said upper movable contact is incorporated into said upper recess in said accommodating portion of said body, in a state where lower faces of tip end portions of said leg portions butt against bottom faces of said first leg accommodating recesses, whereby the upper movable contact is supported above said opening of said upper recess of said accommodating portion to protrude toward the upper face of said body, and the lower faces of said tip end portions of said two leg portions positioned in a diagonal direction of said body are contacted with said second peripheral stationary contacts to be electrically connected thereto.

7. A push-on switch according to claim 6, wherein said dust-proof tape is configured by a soft bonding tape having a bonding layer on one face, and formed into a size and a shape which can cover a substantially whole area of the upper face of said body and hermetically seal said accommodating portion, and bonded to the upper face of said body after said lower movable contact and said upper movable contact are incorporated into an invertible manner in two or upper and lower stages into said accommodating portion of said body.

8. A push-on switch according to claim 7, wherein said cover is formed by a thin metal plate, and configured by: a rectangular top plate which is to overlap with the upper face of said body; first positioning pieces which are downward elongated from middle areas of longitudinal sides of said top plate; second positioning pieces which are elongated from middle areas of lateral sides of said top plate; and a window hole which is formed in a middle area of said top plate, said cover is put on the upper face of said body after said dust-proof tape is bonded to the upper face of said body, said top plate overlays the upper face of said body via said dust-proof tape, said first positioning pieces sandwich said body in the lateral direction, said second positioning pieces sandwich said body in the longitudinal direction, tip end portions of said second positioning pieces are inwardly bent and engaged with the bottom face of said body, said contact body of said upper movable contact which is covered by said dust-proof tape is upward projected from said window hole in the middle area of said top plate, and said cover is fixed to said body in a state where an outer peripheral edge portion of said dust-proof tape is sandwiched between an outer peripheral edge portion of said top plate and an outer peripheral edge portion of the upper face of said body.

9. A push-on switch according to claim 8, wherein said contact body of said upper movable contact which is upward projected from said window hole of said top plate of said cover is downward depressed from a side above said dust-proof tape, whereby said contact body of said upper movable contact is inverted to a downward inflated state to contact with said contact body of said lower movable contact, said upper movable contact and said lower movable contact are electrically connected to each other, said second peripheral stationary contacts and said first peripheral stationary contacts are connected to each other through said upper movable contact and said lower movable contact which are in the electrically conductive state, and a first-step switch enters an ON state, said contact body of said upper movable contact is further downward depressed from the side above said dust-proof tape in a state where the first-step switch is turned ON, and said contact body of said lower movable contact is downward depressed by said contact body of said upper movable contact, whereby said contact body of said lower movable contact is inverted to a downward inflated state to contact with said middle stationary contact, said first peripheral stationary contacts and said middle stationary contact are connected to each other through said lower movable contact, and a second-step switch enters an ON state.

* * * * *